US007228972B2

(12) United States Patent
Ghosh et al.

(10) Patent No.: US 7,228,972 B2
(45) Date of Patent: Jun. 12, 2007

(54) SHORT BAR SEPARATION AND RECOVERY SYSTEM AND METHOD

(75) Inventors: Pradip K. Ghosh, Worcester, MA (US); Bruno Maggioni, Milan (IT)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 11/401,527

(22) Filed: Apr. 11, 2006

(65) Prior Publication Data

US 2006/0237510 A1 Oct. 26, 2006

Related U.S. Application Data

(60) Provisional application No. 60/672,390, filed on Apr. 18, 2005.

(51) Int. Cl.
*B07C 5/14* (2006.01)

(52) U.S. Cl. ..... 209/517; 209/521; 72/203

(58) Field of Classification Search ..... 72/203, 72/228, 234, 250, 251; 209/517, 518, 519, 209/520, 521, 695, 707; 198/360, 368; 83/419, 83/468

See application file for complete search history.

(56) References Cited

U.S. PATENT DOCUMENTS 3,557,952 A * 1/1971 Heikinheimo ..... 209/521
3,805,945 A * 4/1974 Maeda et al. ..... 198/370.05
3,841,180 A * 10/1974 Gutlbauer et al. ..... 83/15
3,923,157 A 12/1975 Cavenar
4,071,958 A * 2/1978 Morita et al. ..... 33/543.1
4,308,958 A 1/1982 Klusmier
4,919,273 A 4/1990 Kruit et al.
4,953,710 A * 9/1990 Chen et al. ..... 209/518
5,400,909 A 3/1995 Tomat et al.
5,507,397 A 4/1996 Bordignon et al.
6,435,352 B1 8/2002 Schoenbeck et al.

FOREIGN PATENT DOCUMENTS

DE 101 27 563 A1 12/2002
JP 03094914 A * 4/1991

* cited by examiner

*Primary Examiner*—Dmitry Suhol
(74) *Attorney, Agent, or Firm*—Gauthier & Connors, LLP

(57) ABSTRACT

A system and method are disclosed for separating and recovering short bars from full length bars in a rolling mill. The bars are initially conveyed on a run-out roller table from a shear to a transfer station where they are accumulated in a layer. The layer is transferred laterally from the transfer station onto a separation roller table at a separation station. An elevator lifts the tail ends of the full length bars off of the separation roller table, and the separation roller table then conveys the short bars to a recovery station. The remaining full length bars are then returned to the transfer station, from where they are sent on to a bundling station.

7 Claims, 2 Drawing Sheets

SHORT BAR SEPARATION AND RECOVERY SYSTEM AND METHOD

CROSS REFERENCE TO RELATED APPLICATION

This application claims priority from provisional patent applications Ser. No. 60/672,390 filed Apr. 18, 2005.

BACKGROUND OF THE INVENTION

1. Field of the Invention

This invention relates generally to rolling mills in which bars of a predetermined length are gathered into bundles, and is concerned in particular with a system and method for separating and recovering unacceptably short bars in advance of the bundling operation.

2. Description of the Prior Art

During the process of rolling bars in a bar mill, merchant mill, or section mill, short bars are invariably produced in the course of producing full length bars (known as commercial order lengths). The bar products can be ribbed reinforcing bars, plain rounds, squares, hexagonals, flats, angles, channels or even in some cases special shapes. Mill operators employ various methods to separate the short bars from the full length bars. These include optimization of billet length, optimization of rolled product length, cropping/chopping off of the short length arisings at mill shears or at the cold shear after the cooling bed. Each of these methods results in some form of cost added to end product.

The principal objective of the present invention is to provide a system and method for minimizing such added costs by separating and recovering short bars in a manner that improves upon the yield of the mill without adversely affecting the mill's throughput.

SUMMARY OF THE INVENTION

In accordance with one aspect of the present invention, a first roller table longitudinally conveys bars from a shear to a transfer station located on one side of a separation station. The bars are accumulated in a layer at the transfer station. A second roller table extends from a terminal stop at the separation station to a recovery station.

A first chain conveyor is operable in a forward direction to transfer the layer of bars laterally from the transfer station onto the second roller table at the separation station. The second roller table is then operated in a forward direction to longitudinally shift all of the bars of the thus transferred layer into an alignment at which the bar front ends abut the terminal stop.

Elevators with open windows are spaced along the second roller table at distances measured from the terminal stop that correspond to the different full length bars being produced by the mill. The appropriate elevator is selected to elevate the tail ends of the full length bars being processed above the second roller table, leaving the tail ends of short bars on the second roller table and aligned with the elevator's open window. The second roller table is then operated in a reverse direction to convey the short bars to the recovery station. The elevator is then lowered to redeposit the tail ends of the full length bars on the second roller table, after which the first chain conveyor is operated in a reverse direction to return the full length bars from the separation station to the transfer station. The bars are then sent on to a bundling station.

If the bars are being counted at the bundling station, then the above described system is adequate. However, if the bars are being pre-counted after shearing, subsequent separation of short bars will result in a number of full length bars less than the pre-counted number. To remedy this shortfall, and in accordance with another aspect of the present invention, a supply of full length bars is held at a make-up station on the opposite side of the separation station. Additional chain conveyors operate to transfer full length bars from the make-up station to the separation station to replace the short bars that have been removed.

These and other features and advantages of the present invention will now be described in further detail with reference to the accompanying drawings, wherein:

DETAILED DESCRIPTION

Figure 1:
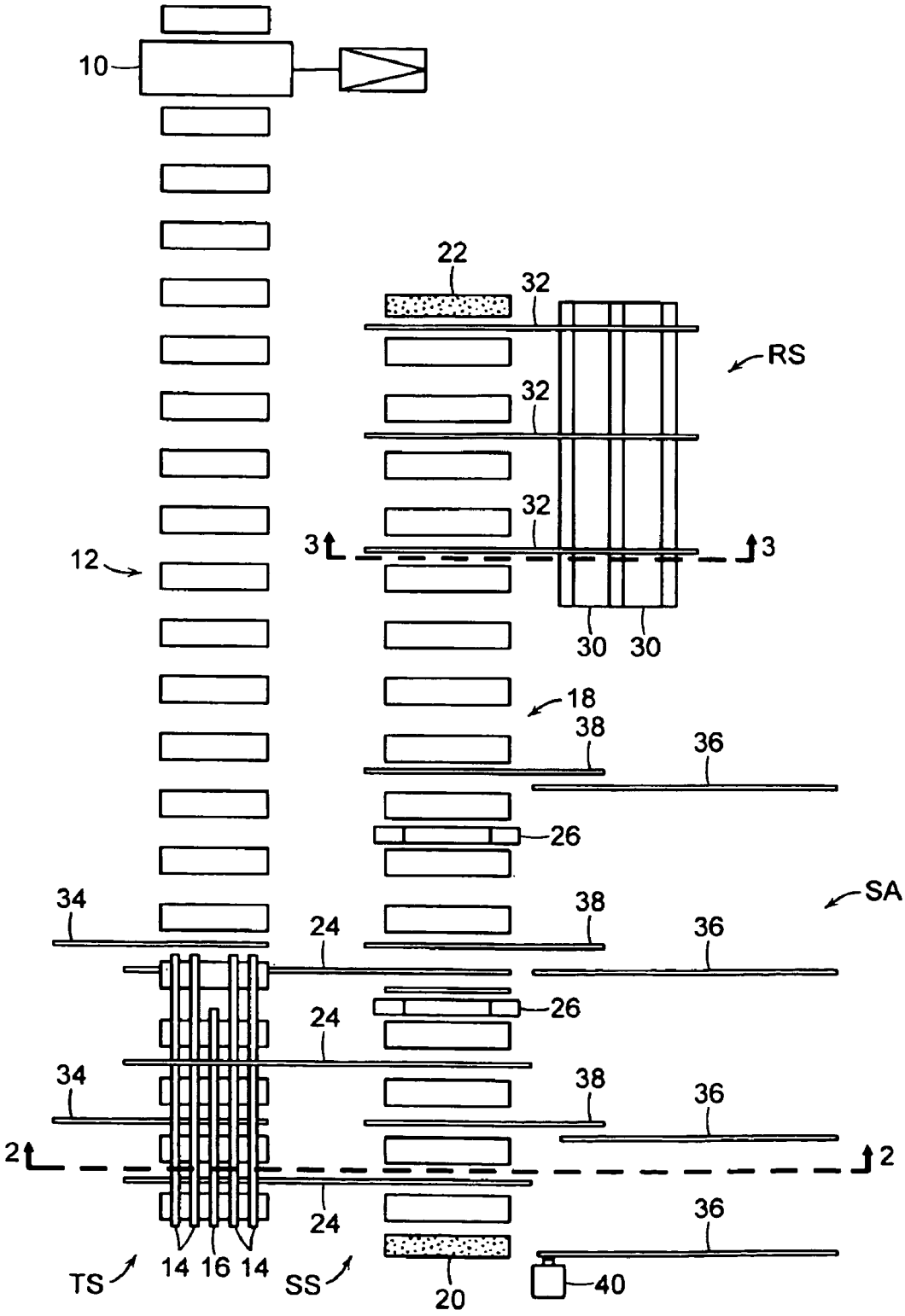
FIG. 1 is a somewhat schematic layout of a system in accordance with the present invention.

With reference initially to FIG. 1, a system in accordance with the present invention is shown on the downstream side of a shear 10. The shear operates to subdivide long products produced by a rolling mill (not shown) into commercial order lengths. As previously noted, short bars are invariably produced along with the full length bars currently being processed.

A first run-out roller table 12 conveys the bars subdivided by the shear longitudinally to a transfer station TS located to one side of a separation station SS. The bars accumulate in a layer at the transfer station. As illustrated in FIG. 1, the layer includes four full length bars 14 and one short bar 16. A second separating roller table 18 extend from a terminal stop 20 at the separation station to another stop 22 adjacent to a recovery station RS. As can be best seen by additional reference to FIGS. 2A and 2B, first chain conveyors 24 extend between the transfer station TS and the separation station SS.

The chain conveyors 24 include horizontal intermediate sections 24*a* and pivotal end sections 24*b*, 24*c*. At least one and preferably multiple elevators 26 are spaced along the length of the separation roller table 18 at the separation station SS. The elevators 26 have open windows 26, and are vertically adjustable between lowered positions below separation roller table 18, and raised positions protruding upwardly above the roller table.

Figure 3:
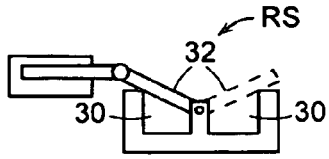
FIG. 3 is a sectional view taken along line 3-3 of FIG. 1.

As shown in FIG. 3, the recovery station RS includes at least one and preferably multiple storage bins 30. Pivotal arms 32 serve to transfer bars from the separation roller table 18 into the appropriate storage bin.

Figure 2A:
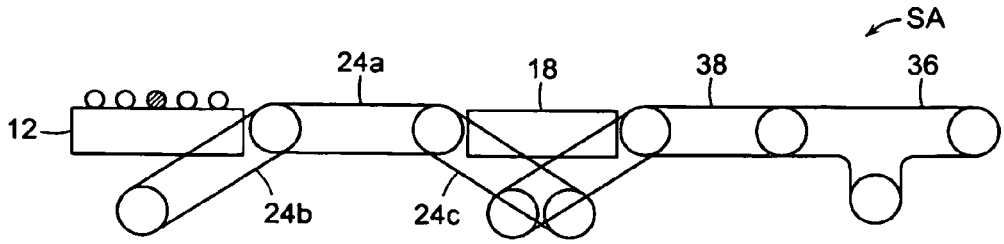
FIGS. 2A and 2B are enlarged sectional views taken along line 2-2 of FIG. 1.
Figure 2B:
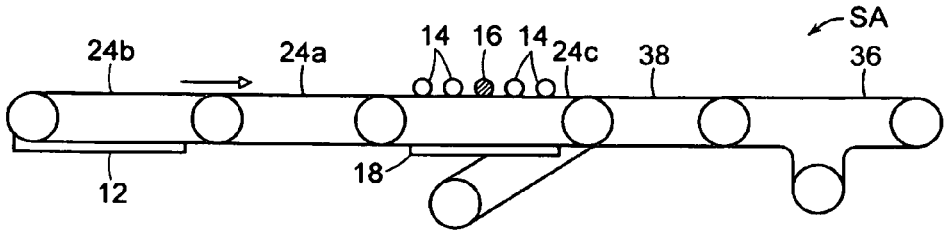
Figure 4:
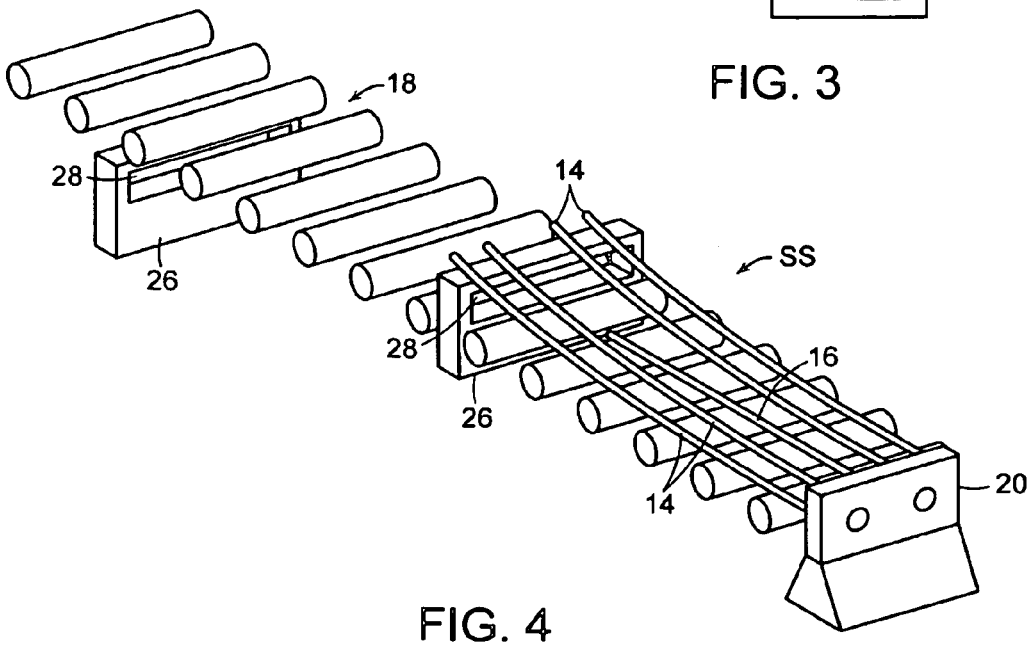
FIG. 4 is a perspective view showing the operation of selected components at the separation station.

In order to separate the short bar 16 from the full length bars 14 in the layer accumulated at the transfer station TS, the system cycles through the following steps:

a) As shown in FIG. 2A, the end sections 24*b*, 24*c* of chain conveyors 24 are pivoted upwardly into horizontal alignment with their intermediate sections 24*a*, which results in the accumulated layer being lifted off of the roller table 12. The chain conveyors 24 are then operated in a forward direction (from left to right as viewed in FIG. 2B) to carry all of the bars of the accumulated layer from the transfer station TS to the separation station SS. As soon as the layer of bars has been shifted laterally onto the chain conveyor sections 24*a*, the end section 24 b is immediately lowered. This clears the separation station TS so that it can receive and accumulate bars in subsequent layers while short bar separation is in process. When the layer containing the short bar reaches chain conveyor end section 24*c*, that section is lowered to deposit the layer on separation roller table 18.

b) The separation roller table 18 is then operated in a forward direction to longitudinally shift all of the thus transferred bars into an alignment at which their front ends abut the terminal stop 20.

c) As shown in FIG. 4, the appropriate elevator 26 is then raised to lift the tail ends of the full length bars 14 above the separation roller table while allowing the tail end of the short bar 16 to remain on the table and in alignment with the window 28 of the elevator.

d) The separation roller table 18 is then operated in a reverse direction to convey the short bar 16 through window 28 and on to a location adjacent to the recovery station RS, with its tail end abutting stop 22. The pivotal arms 32 may then be operated to laterally transfer the short bar into the appropriate storage bin 30.

e) After the short bar 16 has been sent on to the recovery station RS, the elevator 26 is lowered to redeposit the tail ends of the full length bars 14 on the separation roller table 18, and the end sections 24*b*, 24*c* of the chain conveyors 24 are repositioned as shown in FIG. 2B. The chain conveyors 24 are then operated in a reverse direction to laterally transfer the full length bars 14 back to the transfer station TS. From here, the bars may be carried laterally by another chain conveyor system 34 to a bundling station (not shown).

Alternatively, the run-out roller table 12 may be continued through the transfer station TS and used to carry the full length bars longitudinally to a bundling station at another location.

If the bars are being counted after the separation of short bars has taken place, e.g., at the bundling station, then the system as thus far described is adequate. However, if the bars are being counted before the separation stage, then some means should be provided for replacing the separated short bars with full length bars. To this end, the system may optionally include a storage area SA traversed by additional chain conveyors, including for example layer make up chain conveyors 36 and layer integrating chain conveyors 38.

A supply of full length bars 14 may be stored on chain conveyors 36, and as needed, shifted laterally by the chain conveyors 36, 38 to transfer full length replacement bars from the storage area SA onto the separation roller conveyor 18. A bar counting device 40 will keep track of the number of bars being transferred to thus insure that the appropriate number is substituted for the short bars that were previously separated and sent on to the recovery station.

It thus will be seen that if the system is processing full length bars of, for example, 12 meters in length, and periodically short bars measuring 10 meters are produced, the short bars can be separated and stored in one of the bins at the recovery station. During this operation, if the bars were pre-counted before short bar separation, full length bars measuring 12 meters in length can be stored at the storage area SA and used to replace the separated short bars.

If the system then switches to the processing of full length bars measuring 10 meters in length, the previously separated short bars of that length may be recovered from the recovery station RS and reintroduced as replacement bars.

We claim:

1. In a rolling mill in which long products are subdivided by a shear into bars having front and tail ends, a majority of said segments having full lengths, and some of said bars having unacceptable short lengths, a system for separating the bars having short lengths from the bars having full lengths, said system comprising:

a first roller table for longitudinally conveying said bars from said shear to a transfer station located on one side of a separation station and at which said bars are accumulated in a layer;

a second roller table extending from a terminal stop at said separation station to a recovery station;

first chain conveyors operable in a forward direction to transfer all of the bars of said layer laterally from said transfer station onto said second roller table at said separation station, said second roller table being operable in a forward direction to longitudinally shift all of the bars of the thus transferred layer into an alignment at which their front ends abut said terminal stop;

at least one elevator having an open window, said elevator being adjustable between a lowered position beneath said second roller table and a raised position lifting the tail ends of thus aligned full length bars above said second roller table while allowing the tail ends of the thus aligned short bars to remain on said second roller table and in alignment with the window of said elevator, said second roller table being operable in a reverse direction to longitudinally convey the short bars from said separation station through said window to said recovery station, whereupon following return of said elevator to its lowered position to redeposit the tail ends of full length bars on said second roller table, said first chain conveyors are operable in a reverse direction to transfer the full length bars laterally from said separation station to said transfer station.

2. The system of claim 1 wherein said first and second roller tables are parallel.

3. The system of claim 1 wherein a plurality of said elevators are arranged at spaced intervals along the length of said second roller table.

4. The system of claim 1 wherein said recovery station includes at least one storage bin located on one side of said second roller table, and means for laterally transferring short bars from said second roller table into said storage bin.

5. The system of claim 1 further comprising a make-up station at which a supply of full length bars is stored on an opposite side of said separation station, and a second chain conveyors for transferring full length bars laterally from said make-up station onto said second roller table at said separation station to replace short bars that have been conveyed by said second roller table to said recovery station.

6. In a rolling mill in which long products are subdivided by a shear into bars having front and tail ends, a majority of said segments having full lengths, and some of said bars having unacceptable short lengths, a method of separating the bars having short lengths from the bars having full lengths, said method comprising:

longitudinally conveying said bars on a first roller table from said shear to a transfer station located on one side of a separation station and at which said bars are accumulated in a layer;

transferring all of the bars of said layer laterally from said transfer station onto a second roller table at said separation station;

operating said second roller table in a forward direction to longitudinally shift all of the bars of the thus transferred layer into an alignment at which their front ends abut a terminal stop;

vertically adjusting an elevator having an open window from a lowered position beneath said second roller table to a raised position lifting the tail ends of thus aligned full length bars above said second roller table while allowing the tail ends of the thus aligned short bars to remain on said second roller table and in alignment with the window of said elevator;

operating said second roller table in a reverse direction to longitudinally convey the short bars from said separation station through said window to a recovery station; and after returning said elevator to its lowered position to redeposit the tail ends of full length bars on said second roller table, operating said first chain conveyors in a reverse direction to return the full length bars laterally from said separation station to said transfer station.

7. The method of claim 6 further comprising storing a supply of full length bars at a storage station adjacent to said separation station, and replacing the short bars removed from layers at said separation station with full length bars taken from said storage area.

* * * * *